United States Patent [19]

Christ

[11] Patent Number: 4,984,317

[45] Date of Patent: Jan. 15, 1991

[54] METHOD OR APPARATUS FOR TREATING TEXTILE FABRIC OR GOODS

[75] Inventor: Wilhelm Christ, Michelbach an der Bilz, Fed. Rep. of Germany

[73] Assignee: Then Maschinen- und Apparatebau GmbH, Schwäbisch Hall-Hessental, Fed. Rep. of Germany

[21] Appl. No.: 358,680

[22] Filed: May 30, 1989

[30] Foreign Application Priority Data

May 31, 1988 [DE] Fed. Rep. of Germany ..... 3818414

[51] Int. Cl.[5] ..... D06B 5/18

[52] U.S. Cl. ..... 8/149.1; 8/155.1; 8/158; 68/5 C; 68/20; 68/189

[58] Field of Search ..... 8/149.1, 155.1, 158; 68/5 C, 20, 177, 178, 189

[56] References Cited

U.S. PATENT DOCUMENTS

| | | | |
|---|---|---|---|
| 3,960,487 | 6/1976 | Stritzko | 8/155.1 |
| 4,483,032 | 11/1984 | Christ et al. | 8/149.1 |
| 4,829,620 | 5/1989 | Christ et al. | 8/149.1 |
| 4,862,546 | 9/1989 | von der Eltz et al. | 68/5 C X |

FOREIGN PATENT DOCUMENTS

| | | | |
|---|---|---|---|
| 0081362 | 5/1985 | Japan | 8/158 |

*Primary Examiner*—Philip R. Coe

*Attorney, Agent, or Firm*—Frishauf, Holtz, Goodman & Woodward

[57] ABSTRACT

In a method for treating textile fabric (5), such as woven goods, knitted goods, threads, yarns, slivers and the like, with a treatment substance such as revivers or brighteners and the like, the application of the product is performed in the course of the drying process, to save water and energy. The treatment substance is added to the gas stream that is forced through the textile package (5) as it dries.

34 Claims, 5 Drawing Sheets

METHOD OR APPARATUS FOR TREATING TEXTILE FABRIC OR GOODS

FIELD OF THE INVENTION

The present invention relates to a method and apparatus for treating textile goods, and more particularly to treat textile fabric which has been dyed and which is to be treated with additional treatment substance, such as fillers, sizing, brightening, or reviving substances or the like.

BACKGROUND

The application of treatment and brightening or reviving substances to textile fabric in stacks or packages is in most cases done after the dyeing, in a treatment stage following this upgrading process; the textile fabric is placed in a closable or open container that is connected to a circulating pump. The system is then filled with the treatment fluid, which substantially comprises water and the substance for treating the textile goods, to affect the chemical, physical-mechanical or surface property of the goods. In this known method, at least in the remainder of the treatment process, the water serves merely to distribute the treatment means uniformly into, over and through the textile fabrics, by being forced under pressure through the textile material by the circulating pump.

This know method needs improvement, because following the actual upgrading operation, another wet treatment is needed, and for that purpose the entire fluid volume must be brought by heating devices to the treatment temperature, which when reached must be kept constant for a given treatment period, for the desired adsorptive bonding of the products to the fabric to occur.

Moreover, the known method is environmentally undesirable, because large quantities of water have to be mixed with the substance necessary for the treatment, and depending on the extraction performance of the treatment substances, some of them get into sewer systems.

THE INVENTION

It is an object of the invention to provide a method and an apparatus for carrying out the method, in which less energy is required and less waste water is produced than with the known wet treatment method.

Briefly, the textile goods are wound on hollow holders, such as spools or bobbins, which are then placed in a pressure vessel. A gas stream is introduced into the vessel or the hollow holders to which the treatment substance is added in finely divided or dispersed form, to cause the stream to carry and transport the finely divided treatment subtance to the fabric. The stream of gas is forced through the textile fabric, so that the finely divided treatment substance, solely by action of the gas stream, will be directed toward, over, and into the textile fabric. Excess treatment substance is removed by the gas stream.

In accordance with a feature of the invention, the fabric is located in a pressure vessel which defines a treatment chamber, and in which inlet and outlet gas ducts terminate, the treatment chamber, with the inlet and outlet gas ducts, forming part of a gas circulation loop. Components of said gas circulation loop are located outside the treatment vessel, and include a circulating pump to circulate the gas of the loop, which includes the treatment chamber, and an injector or the like to add the treatment substance, in finely divided form, to the gas being circulated in the loop, so that the treatment substance can be carried and transported by the circulating gas into the treatment chamber.

The following discussion of the treatment of textile goods relates to any action upon the textile goods, except for drying, that is performed with the intent of changing the chemical, physical-mechanical or surface property thereof, as for instance is the case when reviving and other preparations are applied. In the novel method, the treatment substances needed for this purpose are transported toward and through the textile goods to be treated not by water, but rather with the aid of a gas stream; the gas stream also assures the uniformity and even distribution of the treatment substance in the textile goods or textile fabric formed by it. To this end, the treatment substabce is fed into the gas stream finely dispersed, thus producing an aerosol that then penetrates the textile fabric.

The method and apparatus have the advantage that, since the aerosol produced has a very low viscosity, low power capacity is sufficient to enable forcing the aerosol through the textile fabric, and the distribution of the treatment substance in the textile fabric is reinforced. Moreover, the specific heat of gas is lower than that of water, so that once again less energy is required to attain and maintain the necessary operating temperatures. Separate heating devices may even be dispensable under some circumstances, since the compression effected by the gas circulating pump assures the necessary temperature increase. Finally, in the novel method, only a very small quantity of waste water is produced, namely only the moisture removed from the textile fabric, or the quantities of water necessary for generating and maintaining the aerosol.

The same gas flow used for treating the goods may be used for drying the goods as well, so that at the same time a gradual drying of the textile goods is attained even during the actual treatment operation. In the simplest case, air is used for this purpose.

If the composition of the gas stream having the finely divided or dispersed treatment substance changes before passing through the textile fabric because it condenses on the tube and boiler walls, and again after emerging from the textile fabric if the treatment substance is extracted from the gas stream, then suitably this extracted treatment substance can be resupplied to the gas stream, finely divided or dispersed again, on the one hand so as to put less burden on the sewage system and on the other hand to make more economical use of the treatment substance.

To obtain a uniform distribution of the treament substances as quickly as possible with thick textile fabrics, the flow direction through the textile fabric is reversed at least once during the complete treatment period, so that the treatment substance can penetrate the textile fabric from both sides.

The flow of gas through the fabric is particularly good when the textile goods are wound on spools, which can be placed in a known manner on material holders or creels in the pressure vessel of pressure dryers. In this arrangement, it is particularly easy to provide a flow from the outside in or from the inside out, which assures uniform distribution of the treatment substance and a uniform flow through the fabric.

Stable operation of the treatment process at the lowest possible temperatures is attained if the temperature is regulated, no later than when a fixed temperature value is attained, solely by varying the cooling. As a result, compared with regulation at the heating device, markedly lower process temperatures are attained, which on the one hand uses less energy and on the other is gentle to the textile fabric.

The desired fine dispersion of the treatment substance can be very simply accomplished by atomizing it with water, and the treatment substance can optionally be emulsified with water beforehand. The addition of the treatment substance can be kept constant over the entire processing time, or it can be varied in accordance with a program, depending on the progress of the treatment substance into the fabric. This closed-loop or open-loop control, under control of command values, of the addition of the treatment substance may use intermittent or pulsed addition of treatment material.

The apparatus for performing the method is preferably a pressure drying system, with a pressure vessel receiving the textile fabric and containing a gas duct system that outside the vessel communicates via lines with a gas circulation pump. A device for the finely dispersed or divided addition of treatment substances is additionally contained in one of the lines, and the gas circulating in the system flows through this device.

Since during the flow through the fabric an approximately adiabatic heating takes place at the circulating pump, damage to the fabric from excessively high process temperatures is prevented by using a cooler located in the loop.

To impose as little aerosol as possible on the compressor of the gas circulating pump, the device for adding the treatment substance in finely dispersed form is suitably located downstream of the compressor.

A flow from the inside out, or from the outside in, in the textile fabric can be attained selectively using a switchover device, which relatively quickly leads to particularly uniform distribution of the upgrading sustance, even in thick textile fabrics.

DRAWING

DETAILED DESCRIPTION

Figure 1:
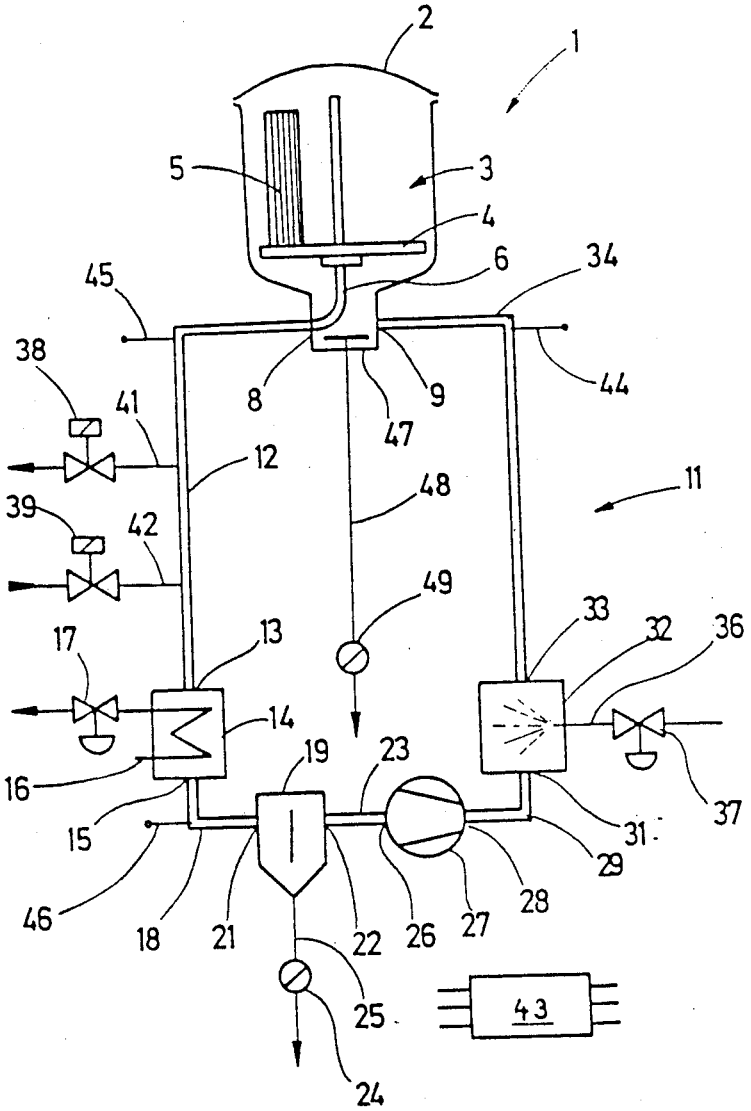
FIG. 1 is a schematic illustration of a system according to the invention for performing the method of the invention.

FIG. 1 shows a system 1 for the simultaneous treating and drying of textile goods, such as fabric, knitted goods, threads, yarns, slivers and the like. The system 1 is designed similar to a once-through pressure drying system and has a pressure vessel 3 closable with a lid 2. A material holder 4 on which packages 5 of textile goods can be placed is located in the pressure vessel 3. These packages 5 are for instance bobbins or spools of yarn, slivers, knits, woven fabric and the like, which are placed in a known manner on creels or spool carriers. The material holder 4 is essentially hollow and communicates hydraulically with a reversible pipeline segment 6, which can be selectively made to communicate at its free end, in a sealed manner, with one or the other vessel fitting 8 or 9; this segment 6 functions like a multi-position cock. A gas circulating device or pumping system is connected outside the pressure vessel 3 to the two fittings 8 and 9 of the pressure vessel 3 and includes a line segment 12 that connects the fitting 8 to an inlet side 13 of a heat exchanger 14 serving as a cooler, from which the air flowing in via the line 12 can flow out via an outlet 15. The cooler 14 also includes a coiled tube 16, schematically shown in the drawing, through which a coolant flows and which is connected at one end, via a continuously adjustable valve 17, to a source (not shown) for the coolant. The flow rate of the coolant through the coiled tube 16 can in this way be varied from 0 to a maximum value continuously, to attain a variable cooling action.

Connected to the cooling device 14 via a line segment 18 is a water trap 19, the inlet 21 of which is fed from the line 18 and the outlet 22 of which is connected to an outward-going line segment 23. At its lowest point the fluid trap 19 contains a drain line 25, which is closable via a condensate diverter 24, for the extraction of collected fluid. From the fluid trap 19, the air circulating in the system 1 flows to an intake side 26 of a compressor 27, the compression or outlet side 28 of which supplies a line segment 29. The line segment 29 connects the outlet or compression side 28 to an inlet 31 of an atomizer 32, which with its outlet 33 communicates via a line segment 34 with the vessel fitting 9. A conduit 36, by way of which a fluid or emulsion to be sprayed or atomized is supplied from a tank, not shown, discharges into the atomizer 32. The quantity of fluid or immersion supplied, which as the treatment substance serves to act upon the package of textile goods, is controlled by means of a regulatable valve 37.

For charging the loop of the system 1 with compressed air or for evacuating it at the end of the process, two conduits 41 and 42, which can be shut off via magnetic valves 38 and 39, discharge into the line segment 12; of these, the conduit 42 leads to a source of compressed air, not shown, while the conduit 41 optionally leads into the open via a filter.

The entire system 1 is controlled via a schematically shown control means 43; the various electrical connecting lines between the control means 43 and the various valves have been omitted from the drawing, for the sake of simplicity. The same is true for the connecting line to remote thermometers 44, 45 and 46, which measure the temperature in the line segment 34, in other words on the windward or supply side or the side of the textile package 5 experiencing the oncoming flow, as well as in the line segment 12 and hence the lee side of the textile package 5, and in the line 18 upstream of the intake side 26 of the compressor 27.

In the event that fluid undesirably collects in the pressure vessel 3, this vessel includes an indentation 47 in its bottom, from which the excess fluid can be removed via a line 48. The removal line 48 is blocked off from the exit of compressed air via a condensate diverter 49.

OPERATION

With the lid 2 open, the wet textile fabric is placed with the material holder 4 into the pressure vessel. The columns formed by the textile packages 5 are secured on the material holder 4 in a known manner by caps and hydraulically closed, so that fluid that flows through the pressure vessel 3 during operation of the system 1 is forced to flow through the textile package 5. After the introduction of the material holder 4, the lid 2 is closed, and the central control means 43 is activated. This causes the closure of all the cocks and valves that have not already closed, before it opens the valve 39 to allow compressed air to flow into the circulating loop of the system 1.

Once a desired air pressure such as 7 bar has been attained, the control means 43 causes the shutoff of the valve 39. Before the system 1 is charged with compressed air, the compressor 27 is switched on by the control means 43; the compressor has begun to circulate the air contained in the loop of the system 1 immediately, and initially the textile package 5 is mechanically dewatered by the air forced through it. The water adhering inside the pores of the textile package 5 is forced out by the air, which the compressor 27 forces into the pressure vessel 3 through the line 34. The circulated air reaches the interior of the pressure vessel 3 through the fitting 9, and from the interior it flows from the outside in through the textile package 5 into the interior of the material holder 4. No other route exists for the flow of air inside the pressure vessel 3. The air flowing out of the textile package 5 has forced the water out, and via the line segment 6 the air reaches the fitting 8; from there the air passes via the line 12 through the initially shut-off cooling means 14 to the fluid trap 19. The entrained water is extracted there. The air, largely freed of water, is finally re-aspirated on the intake side 26 of the 27 and supplied to the pressure vessel 3.

Since once a fixed pressure has been attained in the above-described circulating loop of the system 1 the central control means 43 has closed the valve 39, the air contained in the system 1 is now carried in a closed circulating loop.

Because of the flow resistance presented by the textile package 5, heating of the circulated air occurs more or less rapidly, because it is heated polytropically, or in other words approximately adiabatically in the compressor 27. As soon as the control means 43, with the aid of the temperature sensor 44, ascertains that a fixed temperature has been exceeded on the side exposed to the oncoming flow, or windward side, of the textile package 5, it opens the valve 37, causing the metered inflow of a treatment substance into the atomizer 32 via the line 36. The quantity of treatment substance supplied is defined for instance by calibration of an atomizer nozzle or by a throttle or a metering pump, so that a defined admixture of the treatment substance with the flow of air that passes through the atomizer 32 is obtained. The treatment substance is in flowable form, and after its atomization in the atomizer 32 along with the air flowing through it, an aerosol is created, which is then passed with pressure through the textile package 5. The treatment substance, for instance a reviving substance, preparation or the some other finishing product that acts upon the textile package 5 is transported in this method exclusively by the circulating air.

To prevent the temperature in the system 1 from rising further in the course of time, the central control means 43 begins to open the controllable valve 17 to an increasing extent, to allow coolant to flow through the cooling means 14, in order to cool down the moist and warm air flowing out of the textile package 5 to such an extent that downstream of the compressor 27, at the site where the thermometer 44 measures the temperature, the gas has a desired temperature. As the outflowing air cools, its temperature may possibly drop below the dew point, and the water that the air had absorbed as it flowed through the textile package 5 is extracted from the air to some extent.

Since once a given threshold value determined by a command value has been attained, the system 1 described establishes the air temperature solely by regulating the cooling means 14, the air entering into the textile package 5 is relatively highly saturated; this prevents over-drying in the textile package 5 from the warm air flowing through it in the course of the treatment process.

Once the air has flowed for some time in the manner described, in the course of which treatment substance is continuously added in the atomizer 32, the central control means 43 switches over the line 6 from the fitting 8 to the fitting 9. The circulating air now flows into the textile package 5 as a flow from the inside out, and preferentially supplies the treatment substance to the inner regions of the textile package 5.

Once this phase has continued for long enough as well, the central control means 43 switches the supply of treatment substance off by closing the valve 37. In the phase that now ensues, the treatment substance in the textile package 5 is distributed uniformly by the moist air flowing through; at the same time the remaining residual moisture is removed from the air flowing through, so that after cooling of the air to below the dew point at the cooling means 14, it can be removed in the form of liquid water in the fluid trap 19. The drop below a fixed temperature difference between the temperature measuring devices 44 and 45 is an indication that a desired degree of dryness has been attained.

At that point, the control means 43 will shut off the compressor 27 and relieve the pressure from the system 1 by opening the valve 38. The lid 2 can then be opened and the textile package 5 removed.

Figure 2:
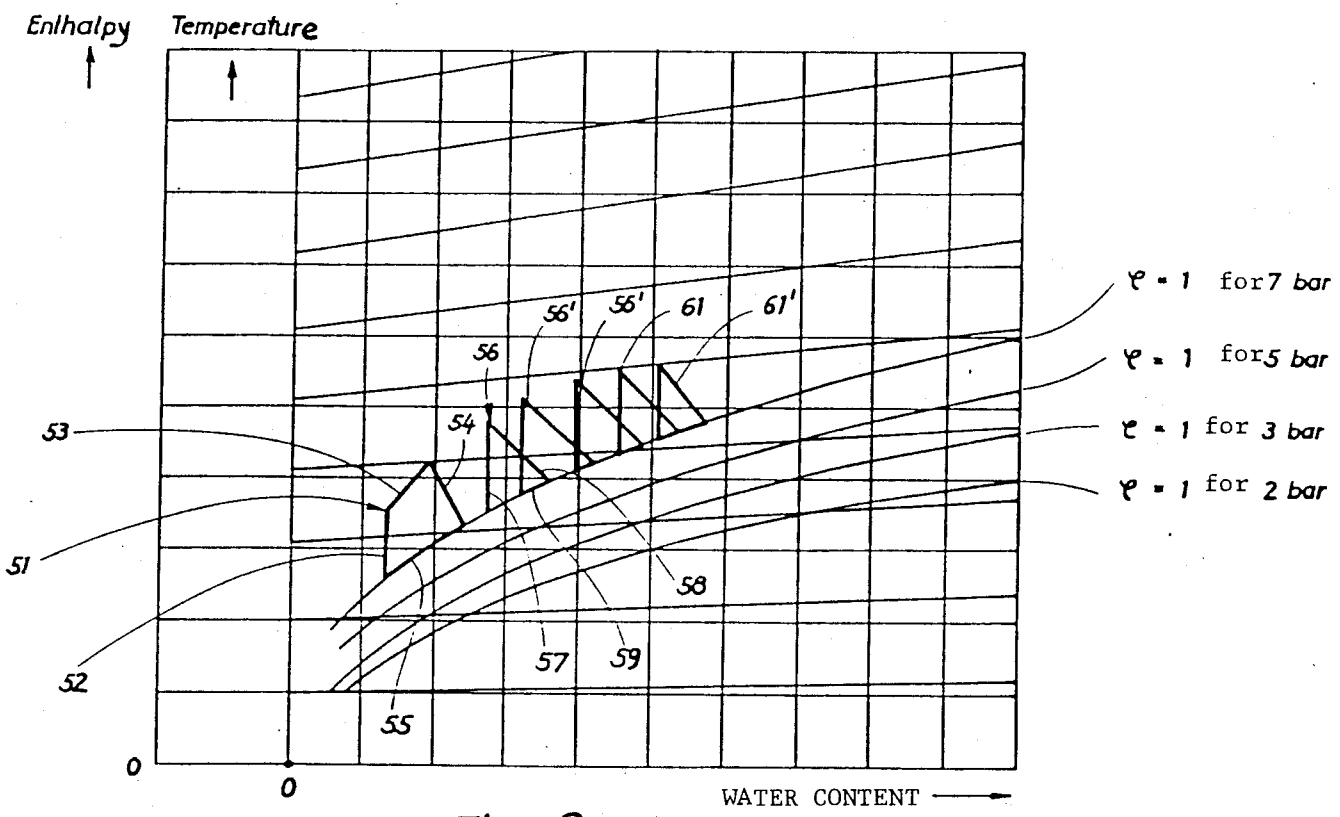
FIGS. 2–4 are various heat balance diagrams of the system of FIG. 1, shown in cherry tree diagrams.

The thermodynamic behavior of the system 1 will now be described in terms of a cherry tree diagram as shown in FIG. 2. For ease of comprehension, it is assumed that little water is supplied by the treatment substance, so that the temperature in the line segment 34, that is, between the outlet 28 of the compressor 27 and the fitting 9 of the vessel 3, remains substantially constant. If larger quantities of water are introduced through the treatment substance, this constant temperature can still be attained by heating the treatment substance to a suitably high temperature. Moreover, any possible cooling of the compressed air by the treatment substance is insignificant, because the temperature is measured not at the outlet of the compressor 27 but rather upstream of the fitting 9 of the vessel 3. It is also assumed that the package 5 is dried at the same time as the treatment substance is applied to the textile package 5, in order to shorten the total treatment time necessary. In this sense, the novel method has considerable advantages, because two process steps, namely the application of treatment substance and drying, can be performed virtually at the same time.

The operating state after the charging of the system 1 to 7 bar and the switching on of a steam supply is shown in FIG. 2 in a heat diagram 51. As the diagram shows, the air is polytropically heated by the compressor 27, initially without varying the proportional of water, as a segment 52 indicates. At the outlet of the compressor 27, the air has a lower degree of saturation but a higher temperature at a constant water content. By supplying steam at a steam supply device, not shown, the air can be both further heated and additionally humidified, as a segment 53 shows. The air, the physical parameters of which are thus adjusted, flows through the textile package 5, simultaneously picking up water and cooling down as it flows through the package 5. For the sake of simplicity, it is assumed that the textile package 5 has a non-hygroscopic material and in fact the cooling threshold temperature is attained; that is, the air that flows out of the package 5 is in fact saturated and at the given temperature cannot absorb any further water. Its saturation content $\phi$ equals 1. The water absorption with simultaneous cooling is represented in the diagram 51 by a segment 54. The saturated air flowing out of the package 5 passes via the line 12 to the cooling means 14, at which it is cooled down to a lower temperature, along the saturation curve where $\phi=1$, at 7 bar, in order to condense the excess water out of it, so that the water can be extracted in the following water trap 19 before the air is again supplied to the intake side 26 of the compressor 27. The heat balance diagram 51 therefore follows the saturation curve in the segment 55.

To attain this heat balance diagram, the adjusting valve 17 is regulated via the central closed- and open-loop control means 43 to a predetermined maximum value, so that a significant cooling action that is near the maximum value is brought about.

The system 1 remains in this operating state until the open- and closed-loop control means, via the temperature sensor 44, measure a temperature in the circulating loop that is above a predetermined threshold value. As soon as this threshold value is exceeded, the open- and closed-loop control means 43 switches off a supply of steam that has been brought about, which stops any further delivery of heat to the circulating loop. At the same time, the open- and closed-loop control means 43 regulates the flow of coolant in the cooling means 14 downward by correspondingly closing the adjusting valve 17, far enough that the rising temperature of the air at the compressor 27 between the inlet and the output side 26, 28 becomes greater than the temperature reduction brought about by the absorption of water in the textile package 5 and by the cooling at the cooling means 14. In this way, a triangular heat balance diagram 56 shown in FIG. 2 is brought about, with a vertically rising segment 57 and a likewise straight segment 58 dropping in the direction toward the saturation curve, and a segment 59 that extends along the saturation curve for $\phi=1$. Since the segment 59 is shorter than the distance between the intersections of the curve segments 57 and 58 with the saturation curve for $\phi=1$, a further increase in the air temperature occurs. The diagram 56 is therefore shifted along the saturation curve for $\phi=1$ gradually to the right in the cherry tree diagram, which is shown in further diagrams 56' and 56''.

The speed with which the shift in the heat balance diagram occurs depends on how the open- and closed-loop control means 43 sets the adjusting valve 17. The farther closed it is, the less coolant can flow through the coiled tube 16, and consequently the less the air flowing out of the bobbin package 5 is cooled before being returned to the compressor 27. The result is a variably rapid temperature increase in the circulating loop. This operating state is maintained until such time as a further temperature threshold is exceeded, which the open- and closed-loop control means 43 again ascertains with the aid of the temperature sensor 44 in the line segment 34. As soon as this threshold value is exceeded, closed-loop control begins via the open- and closed-loop control means 43, such that the temperature in the line segment 34, in other words at the entry to the textile package 5, is kept constant. Without changing the output of the compressor 27, this closed-loop control is attained solely by varying the adjusting valve 17 and hence the cooling action of the cooling means 14. This operating state of the system 1 is illustrated with status diagrams 61 and 61'.

As the status diagrams show, the entire system operates at a constant air temperature on the windward side of the textile package 5. Because the temperature rise in the drying air is effected solely by the action of the compressor 27, and necessarily the extraction of water comes about with the aid of a dew point condensation, the relative humidity of the air on the windward side of the textile package 5 is relatively high, since the temperature, increase, which is brought about solely by the polytropic compression action of the compressor 27, is relatively slight. Nevertheless, the process remains controllable by closed-loop means, in that the action of the cooling means 14 is varied simply by the open- and closed-loop control means 43. In this way, the changes in the flow resistance in the textile package 5 are automatically taken into account as well, because with decreasing moisture in the textile package 5, the flow resistance and hence the compression action of the compressor 27 vary as well. The consequence is a slighter temperature rise, and for that reason the cooling action by the cooling means 14 is regulated in followup fashion, the prevent a shift to the left of the status diagram along the curve for $\phi=1$ in the cherry tree diagram.

Despite the fact that the entry temperature for the air at the package 5 is kept constant and despite a relatively high water content in the drying air, a continuous extraction of water takes place, which permits the high degree of dryness needed.

If a constant stationary operation is desired, in which no further water is extracted from the textile package 5, then a moistening device can be set in motion by the open- and closed-loop control means 43. If the amount of water absorbed by the air here is equal to the quantity of water extracted at the water trap 19, then finally no further water will be extracted from the package 5; instead, the process remains stationary. Since no other energy sources are available except for the capacity of the compressor 27, only a relatively slight amount of heat needs to be extracted by the cooling means 14 as well, so that overall the system operates in such a way to save both cost and energy, even though it remains generally controllable by closed-loop means.

From the status diagrams 61 and 61' of FIG. 2, it can also be found that the temperature at the output of the package 5 can be used as a criterion for the dried status. With increasing drying of the textile package 5, the temperature of the air flowing out of the package 5 in fact increases. To detect the dried state, the temperature sensor 45 is provided in the line segment 12.

Figure 3:
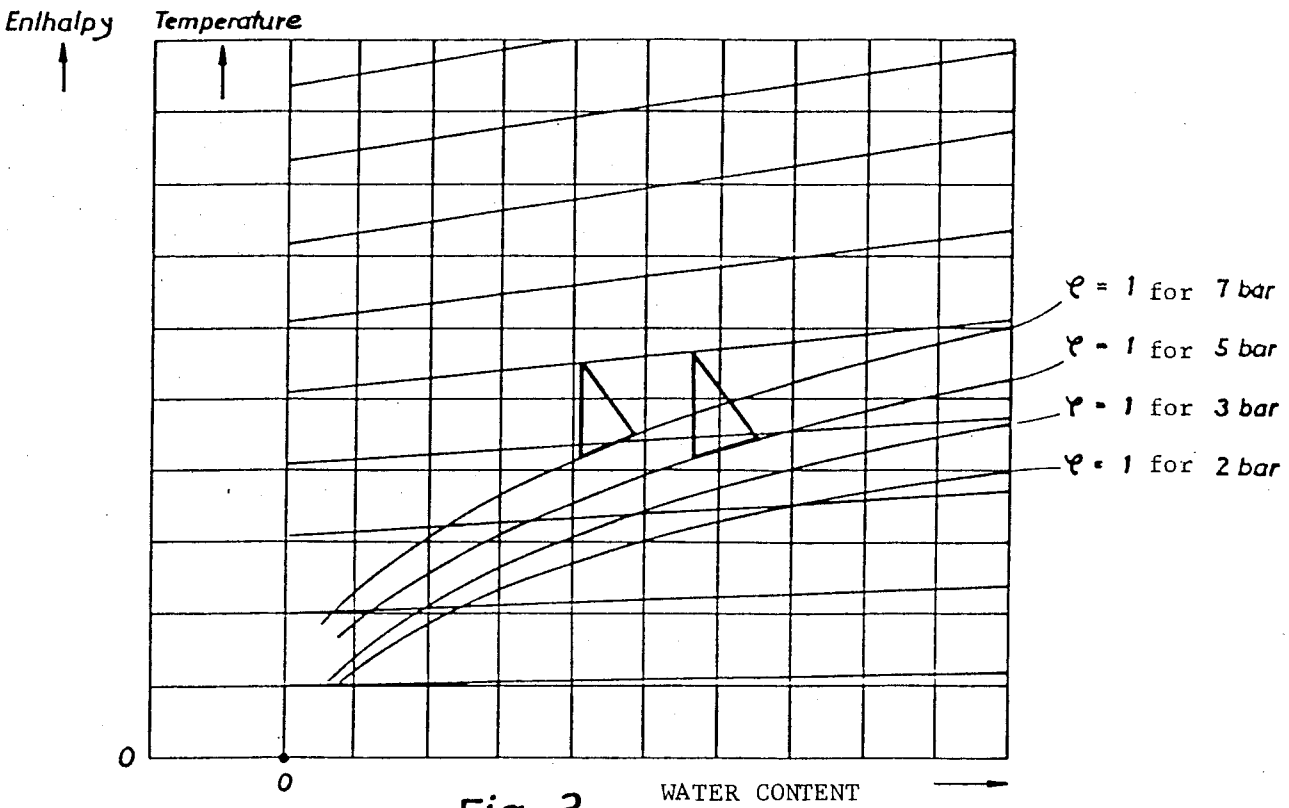

If the reduction in flow resistance of the textile package 5 in the course of the drying process leads to the exceeding of the allowable operating point of the compressor 27, then as FIG. 3 shows the pressure in the system can be reduced, for instance from 7 bar to 5 bar. This likewise shifts the status diagram to the right, and simultaneously the degree of saturation of the air at the entry into the textile package 5 also increases, despite the fact that the air temperature in the line segment 34 is kept constant.

Figure 4:
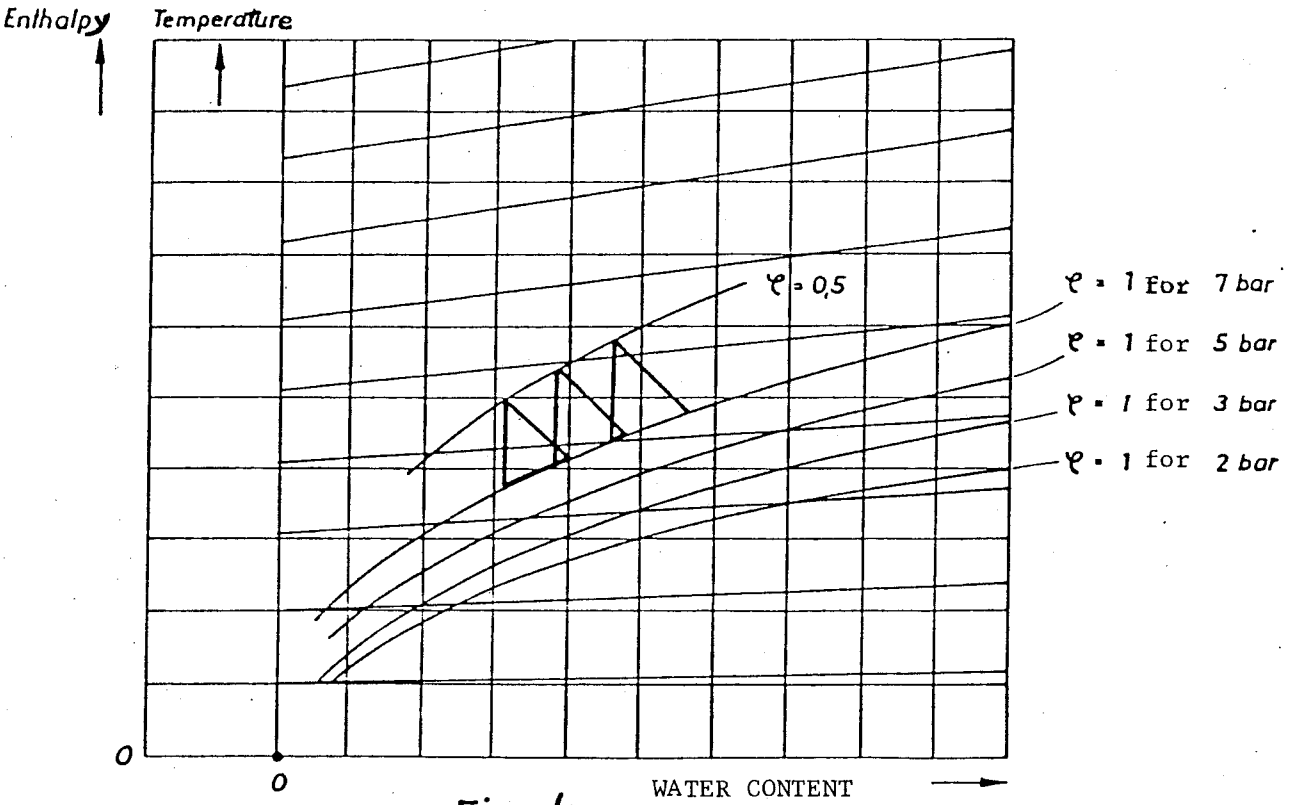

As FIG. 4 shows, operation at a constant degree of saturation of the air entering into the textile package 5 is also possible with the system 1 shown, if a hygrometer is used instead of the temperature sensor 44. In that case, the system 1 is adjusted by the open- and closed-loop means 43 such that on the windward side of the package 5, the air has a constant degree of saturation, for instance 0.5, over the entire operating period. As drying proceeds, the heat balance diagram would shift toward the left in the direction of a lesser water content along the saturation curve $\phi=1$.

Once the desired dryness of the textile package 5 is attained, a cooling phase begins, with the air temperature in the line segment 8 gradually regulated in reverse, which is accomplished by increasing the cooling action at the cooling means 14. To this end, the guide variable with which the measured value appearing at the temperature sensor 44 is continuously compared, in order to adjust the adjusting valve 17, is varied within the open- and closed-loop means 43 in accordance with a desired predetermined program.

In each case, the system 1 remains capable of closed-loop control, and the operation takes place at a lower power level.

Figure 5:
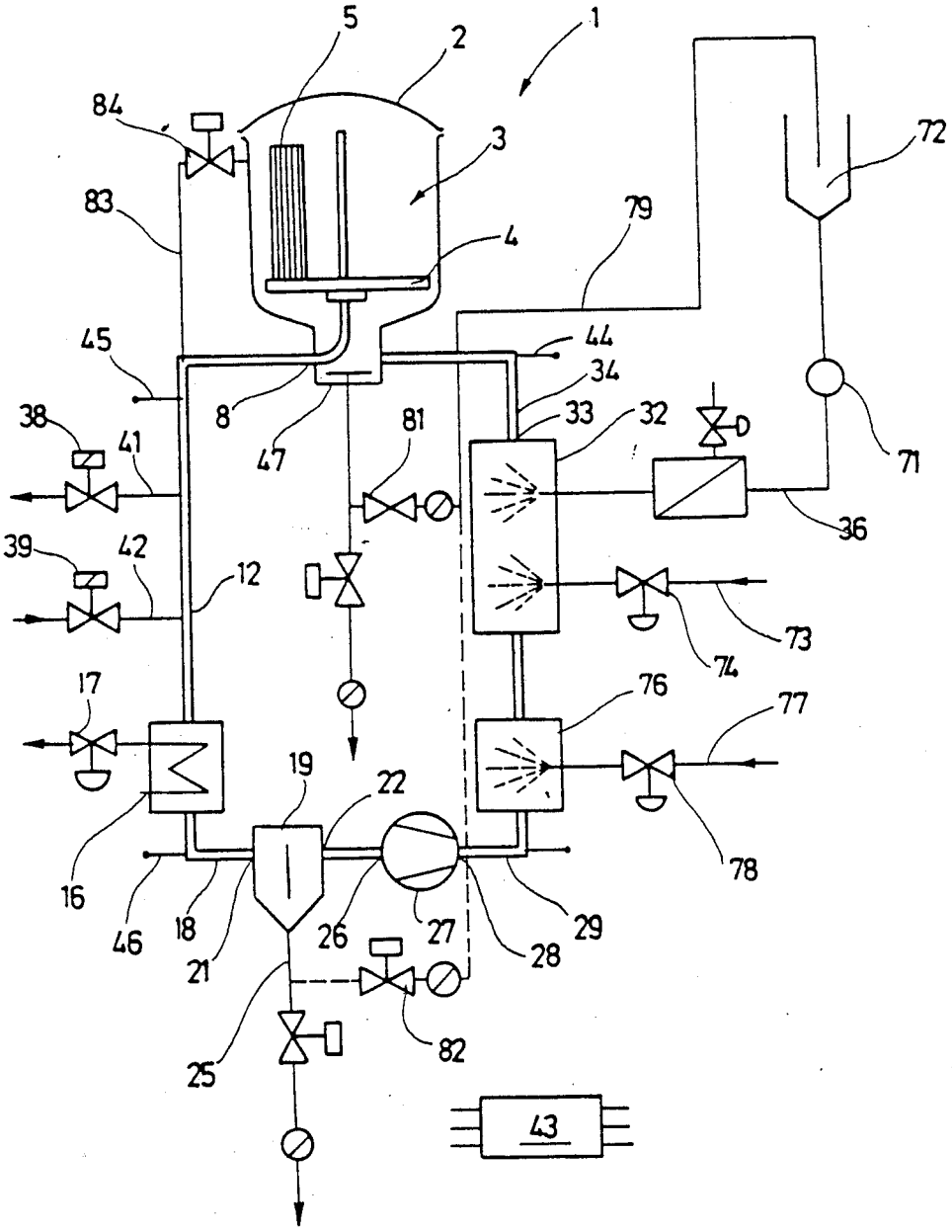
FIG. 5 shows the system of FIG. 1 with various devices for recirculating extracted treatment substance.

FIG. 5 shows a further variant of the system 1 of FIG. 1, for enabling additional intervention and closed-loop control options in the process. Components of the system that have already been shown in and described in conjunction with FIG. 1 are accordingly referred to below by the same reference numerals without further explanation.

In FIG. 5, in the line 36 for the treatment substance, there is instead of the valve 37 a metering pump 71 that can be switched on and off selectively by the control means, in order to aspirate the treatment substance in suitable quantities selectively from a supply container 72 and atomize it at the outlet of the line 36. As before, the outlet of the line 36 is located in the atomizer 32, in which a water line 73 discharges as well, for injecting additional water in the atomizer 32. The line 73 can be shutoff by a controlled valve 74 or opened more or less widely, in order to adjust the quantity on the one hand and the droplet size on the other. Also located in the line 29 between the atomizer unit 32 and the compressor 27 is a steam supply device 76, which makes it possible to supply steam, to the air circulated in the system via a line 77 that communicates with a steam generator, not shown, and can be shut off by means of a valve 78 by the control means 43.

The system 1 of FIG. 5 also differs from that of FIG. 1 in a number of provisions for returning treatment substance that has condensed at various points in the system 1 to the supply container 72. For this purpose, a return line 79 is provided, which discharges into the supply container 72 and via valves 81 and 82 communicates with both the outlet 25 of the fluid trap 19 and the sump 47 of the pressure vessel 43.

Finally, a bypass 83 is also provided, which at one end discharges into the line segment 12 and at its other end is connected to the pressure vessel 3 The bypass 83 can be closed selectively by a valve 84; it serves to clean the pressure vessel by removing treatment substance.

With the system 1 shown in FIG. 5, it is possible for a textile package 5 introduced into the pressure vessel 3 to be conditioned in terms of moisture and temperature, by opening the valve 68 and blowing in steam to the air circulating loop, in such a way that the desired preconditions are attained for the ensuing treatment operation.

This kind of conditioning may for instance be necessary if a dry textile package is used at the outset, and the treatment substance to be applied requires greater moisture in the package, for the sake of sufficient migration. In that case, the system is set into motion in the same manner as described above, but the central means 43, prior to adding the treatment substance, first opens the valve 78, to allow steam to flow into the system. This accomplishes two things: First, the temperature of the air circulating in this system rises, and second, moisture is supplied to the textile goods. The injection of steam is also suitable even if the goal is merely to reach operating temperature as fast as possible, so that the addition of the treatment substance can begin as soon as possible.

Once the desired operating parameters have been attained, the control means 43 shuts off the valve 78, in order to start up the metering pump 71 immediately. The treatment substance is now finely atomized, as described above, so that it is distributed within the textile package 5 with the aid of the circulating air.

In the course of the treatment process, if the temperature should rise too high or the moisture in the goods should drop too severely, because the aerosol produced in the atomizer 32 has less water than is removed at the trap 19, additional water can be fed into the circulating loop by opening the valve 74.

Excess treatment substance, and/or treatment substance that has condensed on the walls of the pressure vessel 3 or circulating pump 11, collects for example either in the fluid trap 19 or the sump 47, and can be returned to the supply container 72 from which the metering pump 71 supplied via the line 79, by the opening the proper valves 81, 82.

Since in the drying process, with the simultaneous application of treatment products, a steam-saturated air flow is as a rule present at the intake side 26 of the compressor 27, a superheated gas state results at the compression side 28, which is dependent on the pressure increase of the compressor and on the static overpressure. If the associated temperature is kept constant, specifically by the closed-loop control of the cooler 14, then with the proportion of dilute product introduced via the metering pump, for example based on a cation-active brightening or reviving substance or preparation in a proportion of 10 to 15 liters per 100 kg of textile goods, with a predetermined quantity of the reviving substance fed in, in terms of percent by weight of the desired product applied with respect to the dry weight of the textile goods, a portion of the water evaporates in the superheated air flow, and as a result its temperature drops. For keeping the air temperature prevailing at the pressure fitting 28 constant, in the form of an effective entry temperature into the textile package, a flash heater 85 having a regulating valve 86 is incorporated between the metering pump and the injection nozzle, so that the treatment substance is distributed in the air flow isothermically. Particularly with paraffin emulsions, which are not spread onto the textile substrate but rather distributed in a manner that is promoted by the evaporation of the water and simultaneous drying of the textile package, it is recommended that after the product is applied water be atomized via the regulating valve 54, and with this atomization the greasy emulsion coating on the steel parts of the material holder are washed off, yet contrarily the application of the preparation to the textile package is not impaired.

With the apparatus described, it is also possible to flush any residues of previous treatments that may still be present out of the textile package 5. To this end, before the application of reviving or brightening substance, pure water is introduced into the gas stream by opening the valve 74. The resultant aerosol containing water, as it flows through the textile package, carries the undesired residues along with it out of the package 5. It will be understood that the quantity of water is dimensioned with a view to particularly good rinsing, and according may under some circumstances be considerably greater than the quantity of water used when the treatment substance is applied. Nevertheless, the consumption of water is comparatively less than with rinsing in a water bath.

Various changes and modifications may be made, and features described in connection with any one of the embodiments may be used with any of the others, within the scope of the inventive concept.

I claim:

1. A method of treating textile goods or fabric with a treatment substance in which the textile goods are wound packages (5) retained on a holder structure (4);

placing the holder structure (4) with the wound package (5) of textile goods thereon into a vessel (2) defining a treatment chamber;

applying a stream of gas to the wound package (5) of textile goods in the chamber;

adding the treatment substance to the gas stream in finely dispersed or divided form to cause the gas stream to carry and transport said finely dispersed treatment substances, wherein the step of applying the gas stream to the textile goods comprises forcing the gas stream through the wound textile goods and distributing said treatment substances solely by action of the gas stream toward, over, and into the textile goods;

removing the stream of gas after having passed through the wound package of textile goods from the vessel; and removing excess treatment substances by said gas stream.

2. The method of claim 1, wherein the step of applying the gas stream to the textile goods comprises applying a drying gas stream to dry damp or wet textile goods so that the textile goods are simultaneously treated and dried.

3. The method of claim 1, wherein the textile goods are at least moistened prior to the application of the treatment substance.

4. The method of claim 3, wherein the textile goods are wet prior to the application of the treatment substance.

5. The method of claim 1, wherein the gas stream is at a static pressure level that is above atmospheric pressure, so that the above-atmospheric pressure prevails in the gas stream upstream and downstream of the textile fabric.

6. The method of claim 1, including the step of extracting treatment substance from the gas stream flowing out of the textile goods; and adding said extracted treatment substance in, finely dispersed form, into the gas stream for repeat application to the textile goods.

7. The method of claim 1, wherein the flow direction of the gas stream through the textile goods is reversed at least once during the treatment period.

8. The method of claim 1, wherein the textile goods are wound onto a plurality of holder elements to provide good gas flow toward, over, and into the textile goods.

9. The method of claim 8, wherein the textile goods are wound on bobbins, said bobbins forming part of the holder structure.

10. The method of claim 1, wherein the textile goods is located in a vessel hydraulically communicating with a gas circulating device by means of which the gas stream through the textile fabric is maintained.

11. The method of claim 1, wherein the gas stream is cooled downstream of the textile fabric.

12. The method of claim 1, wherein the temperature of the gas stream at the entry side into the textile fabric is regulated in accordance with a command value.

13. The method of claim 12, including the step of cooling the gas stream after it has passed through the textile goods; and wherein the temperature, after attaining a fixed value, is regulated solely by regulation of cooling of the gas stream.

14. The method of claim 12, wherein the command value is substantially constant during the treatment period.

15. The method of claim 12, wherein the command value varies during the treatment period in accordance with a fixed program.

16. The method of claim 1, wherein the gas stream is circulated in a loop.

17. The method of claim 1, including the step of atomizing the treatment substance in the gas stream to obtain fine dispersion thereof.

18. The method of claim 17, wherein for the atomization, water or steam is used.

19. The method of claim 1, including the step of preparing the treatment substance, prior to the fine dispersion in the gas stream in the form of an aqueous emulsion or a colloidal solution.

20. The method of claim 1, wherein the treatment substance is added to the gas stream by open-loop control or closed-loop control in accordance with a command value.

21. The method of claim 1, wherein the quantity of treatment substance added to the gas stream is kept constant over the treatment period.

22. The method of claim 1, wherein the quantity of treatment substance added to the gas stream is reduced gradually or in stages at least toward the end of the treatment period.

23. The method of claim 1, wherein water in liquid or vapor form is added to the gas stream at least during an interval during the treatment period.

24. The method of claim 1, wherein the addition of the treatment substance to the gas stream does not begin until a fixed moisture value is attained in the textile fabric.

25. The method of claim 1, wherein the treatment substance is added isothermically.

26. The method of claim 1, wherein prior to the application of the treatment substance to the textile fabric, the textile fabric is rinsed with water atomized in the gas stream, the water being transported by the gas stream.

27. In combination with textile goods, an apparatus for treating said textile goods, carrying out the method of claim 1, comprising a vessel (3) defining a treatment chamber having said textile goods located therein;

a holder structure arranged for holding said textile goods thereon in wound package form whereby said textile goods will form wound packages (5) of textile goods on the holder structure, said holder structure with the wound textile goods packages thereon being located within the treatment chamber;

a gas generating and circulating loop system (3, 4, 5, 8, 9, 12, 18, 27, 29, 34) including inlet gas duct means (9) located in said vessel and communicating with said treatment chamber;

outlet gas duct means (8) for removal of gas from said treatment chamber;

a circulating gas pump (27) located outside of said vessel for supplying a stream of gas under pressure through said inlet means into said vessel and through said packages of textile goods;

means (32) for adding a treatment substance, in finely divided or dispersed form, located outside of said vessel, said treatment substance adding means adding treatment substances to the gas stream supplied into said vessel, said gas stream passing through said vessel and through said goods on said holder structure and hence distributing said treatment substances solely by action of the gas stream toward, over, and into the textile goods in said chamber, said gas stream being supplied by said gas pump for additionally removing excess treatment substances from the goods.

28. The apparatus of claim 27, further including a cooler (14) and a fluid trap (19) connected in said loop system between the outlet duct means (8) from the vessel (3) and said gas pump (27).

29. The apparatus of claim 27, wherein the gas pump is a compressor (27).

30. The apparatus of claim 29, wherein the treatment substance adding means (32) is positioned between the compressor (27) and the inlet duct means (9) to said vessel.

31. The apparatus of claim 27, wherein the textile goods are positioned on the holder structure in form of a textile package defining an inside and an outside; and further including a switch-over device (6) for controlling the gas stream, selectively, from the outside in, or from the inside out, of the textile package in said vessel (3).

32. The apparatus of claim 27, wherein the holder structure is hollow, and positioned and shaped to force the gas stream through the textile goods and distribute said treatment substances solely by action of the gas stream toward, over, and into the textile goods.

33. The apparatus of claim 27, wherein said vessel (3) is a pressure vessel and the gas generating system provides gas under pressure into said vessel.

34. The apparatus of claim 27, wherein the gas generating system is a closed loop comprising the vessel (3), the gas inlet (9) and gas outlet (8) duct means, the gas pump (27), and said means for adding the treatment substance (23) to the gas circulating in said loop.

* * * * *